US009908229B2

(12) United States Patent
Wang

(10) Patent No.: US 9,908,229 B2
(45) Date of Patent: Mar. 6, 2018

(54) MULTI-MODE DRILL AND MODE SWITCHING MECHANISM THEREOF

(71) Applicant: CHERVON INTELLECTUAL PROPERTY LIMITED, Road Town (VG)

(72) Inventor: Liang Wang, Nanjing (CN)

(73) Assignee: Chevron (HK) Limited, Wanchai (HK)

( * ) Notice: Subject to any disclaimer, the term of this patent is extended or adjusted under 35 U.S.C. 154(b) by 491 days.

(21) Appl. No.: 14/597,617

(22) Filed: Jan. 15, 2015

(65) Prior Publication Data

US 2015/0202759 A1 Jul. 23, 2015

(30) Foreign Application Priority Data

Jan. 21, 2014 (CN) ..... 2014 1 0027302

(51) Int. Cl.
*B25D 16/00* (2006.01)
*B25B 21/00* (2006.01)

(52) U.S. Cl.
CPC ..... *B25D 16/006* (2013.01); *B25B 21/00* (2013.01); *B25D 16/003* (2013.01); *B25D 2216/0023* (2013.01); *B25D 2216/0038* (2013.01); *B25D 2250/165* (2013.01); *B25D 2250/255* (2013.01); *Y10T 74/11* (2015.01)

(58) Field of Classification Search
CPC ..... B25F 5/00; B25D 16/006; B25B 321/00; F16H 35/12
USPC ..... 173/47, 48, 216; 475/298, 299, 317
See application file for complete search history.

(56) References Cited

U.S. PATENT DOCUMENTS

| | | | | |
|---|---|---|---|---|
| 7,044,882 | B2 * | 5/2006 | Eisenhardt | B25F 5/001 475/298 |
| 2006/0086514 | A1 * | 4/2006 | Aeberhard | B25B 21/00 173/48 |
| 2010/0193206 | A1 * | 8/2010 | Teng | B25B 21/02 173/48 |

* cited by examiner

*Primary Examiner* — Nathaniel Chukwurah
(74) *Attorney, Agent, or Firm* — Greenberg Traurig, LLP

(57) ABSTRACT

A multi-mode drill includes a housing, a motor and a transmission mechanism, wherein the motor and the transmission mechanism are received in the housing. The transmission mechanism has a gear reduction component and a main shaft, wherein the gear reduction component is driven by the motor, and the main shaft is connected with the gear reduction component and driven by the gear reduction component to rotate. The multi-mode drill further includes a mode switching mechanism for causing the transmission mechanism to operate in different modes. The mode switching mechanism includes an operation member and an actuator. The actuator is actuated by the operation member and engages with the transmission mechanism. At least an elastic energy storage member is arranged between the operation member and the actuator.

7 Claims, 8 Drawing Sheets

MULTI-MODE DRILL AND MODE SWITCHING MECHANISM THEREOF

RELATED APPLICATION INFORMATION

This application claims the benefit of CN 201410027302.8, filed on Jan. 21, 2014, the disclosure of which is incorporated herein by reference in its entirety.

FIELD OF THE DISCLOSURE

The present disclosure relates to electric drills, and more particularly to a multi-mode drill adapted to switch between different operation modes and a mode switching mechanism thereof.

BACKGROUND OF THE DISCLOSURE

A multi-mode drill may have a plurality of operation modes, such as a drill mode with a continuous rotation of the output shaft, a clutch mode in which the output shaft rotates and the clutch mechanism is activated to control the output torque, a hammer drill mode with rotation and reciprocating impact of the output shaft, and an impact mode with rotation and rotary impact of the output shaft.

This kind of multi-mode drill generally includes a mode switching mechanism mounted at a housing for switching operation modes of the tool. By selecting the position of an operation member outside the housing, the operator can choose the state of the mode switching mechanism corresponding to different operation modes. However, in the mode switching process, the operation member may be unduly blocked and difficult to be moved because of the interaction of the various mechanisms inside the housing. In this instance, the operator must inconveniently re-start the tool to make the internal mechanisms release from the blocked position and then shut down the tool and carry out the mode switching.

SUMMARY OF THE DISCLOSURE

To overcome the drawbacks in the prior art, an object of the present disclosure is to provide a multi-mode drill that prevents blocking of a mode switching operation member and a mode switching mechanism thereof, which facilitates mode switching operation, and achieves better operation feelings.

To achieve the above object, the present disclosure employs the following technical solution:

A described multi-mode drill includes a housing, a motor and a transmission mechanism, wherein the motor and the transmission mechanism are received in the housing, the transmission mechanism includes a gear reduction component and a main shaft, wherein the gear reduction component is driven by the motor, and the main shaft is connected with the gear reduction component and driven by the gear reduction component to rotate, the multi-mode drill further includes a mode switching mechanism capable of switching the transmission mechanism to operate in different modes, wherein the mode switching mechanism includes an operation member and an actuator, wherein the actuator is actuated by the operation member and engages with the transmission mechanism, wherein at least an elastic energy storage member is arranged between the operation member and the actuator.

Furthermore, the operation member may be substantially ring-shaped and capable of rotating about a central axis of the main shaft and the actuator may be substantially ring-shaped and arranged coaxially with the operation member.

Furthermore, the operation member may define a first chamber and a second chamber adjacent to the first chamber, the multi-mode drill may comprise include two elastic energy storage members respectively received in each of the first, second chambers, the actuator may comprise include a stop boss extending into the space between the two elastic energy storage members, and the stop boss may be biased by the corresponding elastic energy storage member when the operation member rotates clockwise or counterclockwise.

Furthermore, the first and second chambers may be communicated with each other and the stop boss may be capable of entering into the first and second chambers.

Furthermore, the stop boss may be in contact with both of the two elastic energy storage members under the free state of the two elastic energy storage members with no energy stored.

Furthermore, the operation member may include a side wall substantially perpendicular to the central axis, the first and second chambers may be circumferentially arranged on the side wall about the central axis, the first, second chambers and the stop boss may be substantially arc-shaped, and the elastic energy storage members may be substantially arc-shaped when received in the first and second chambers.

Furthermore, the transmission mechanism may have a clutch mode and a non-clutch mode, the mode switching mechanism may be capable of switching the transmission mechanism to operate in the clutch mode or non-clutch mode, and the transmission mechanism may further include a clutch component capable of interrupting the torque output of the main shaft from the motor when the torque greater than a predetermined threshold is imposed on the main shaft in the clutch mode.

Furthermore, the gear reduction component may be a planetary gear reduction component which includes an internal gear, the clutch component may include several protrusions located at an end face of the internal gear, several engagement members may be used to keep engagement with the end face of the internal gear, and a pressing member may engage with the engagement members with at least a biasing member biasing the pressing member.

Furthermore, the actuator may include at least a protrusion extending along an axis parallel with the central axis, the pressing member may define at least a notch corresponding to the protrusion, the protrusion may aim at toward the notch in the clutch mode and the protrusion may press on the pressing member in the non-clutch mode.

Furthermore, the multi-mode drill may further include circumferentially arranged and different marks provided on the housing adjacent to the operation member where the marks are capable of indicating the working modes of the transmission mechanism corresponding to the different positions of the operation member.

A described mode switching mechanism includes an operation member, an actuator and two elastic energy storage members arranged between the operation member and the actuator, the operation member is substantially ring-shaped and capable of rotating about a central axis, the actuator is substantially ring-shaped and arranged coaxially with the operation member, the operation member includes a side wall substantially perpendicular to the central axis and defining a first chamber and a second chamber adjacent to the first chamber, the first and second chambers being substantially arc-shaped and circumferentially arranged on the side wall about the central axis, the elastic energy storage members are respectively and substantially arc-shaped when received in each of the first, and second chambers, the actuator includes a stop boss which is substantially arc-shaped and extends into the space between the two elastic energy storage members, the stop boss is biased by the corresponding elastic energy storage member when the operation member rotates clockwise or counterclockwise.

According to the present disclosure, by arranging the elastic energy storage member between the operation member and the actuator, blocking that previously occurred in the mode switching process due to the interaction of the internal mechanism is solved, especially the blocking of the operation member resulting from skipping when switching from the clutch mode to the non-clutch mode. The described system also provides good operation feelings and the structure is simple and reliable, which is convenient for the operator to use.

DETAILED DESCRIPTION OF PREFERRED EMBODIMENTS

The present disclosure will be introduced in detail with reference to the figures and specific, exemplary embodiments.

Figure 1:
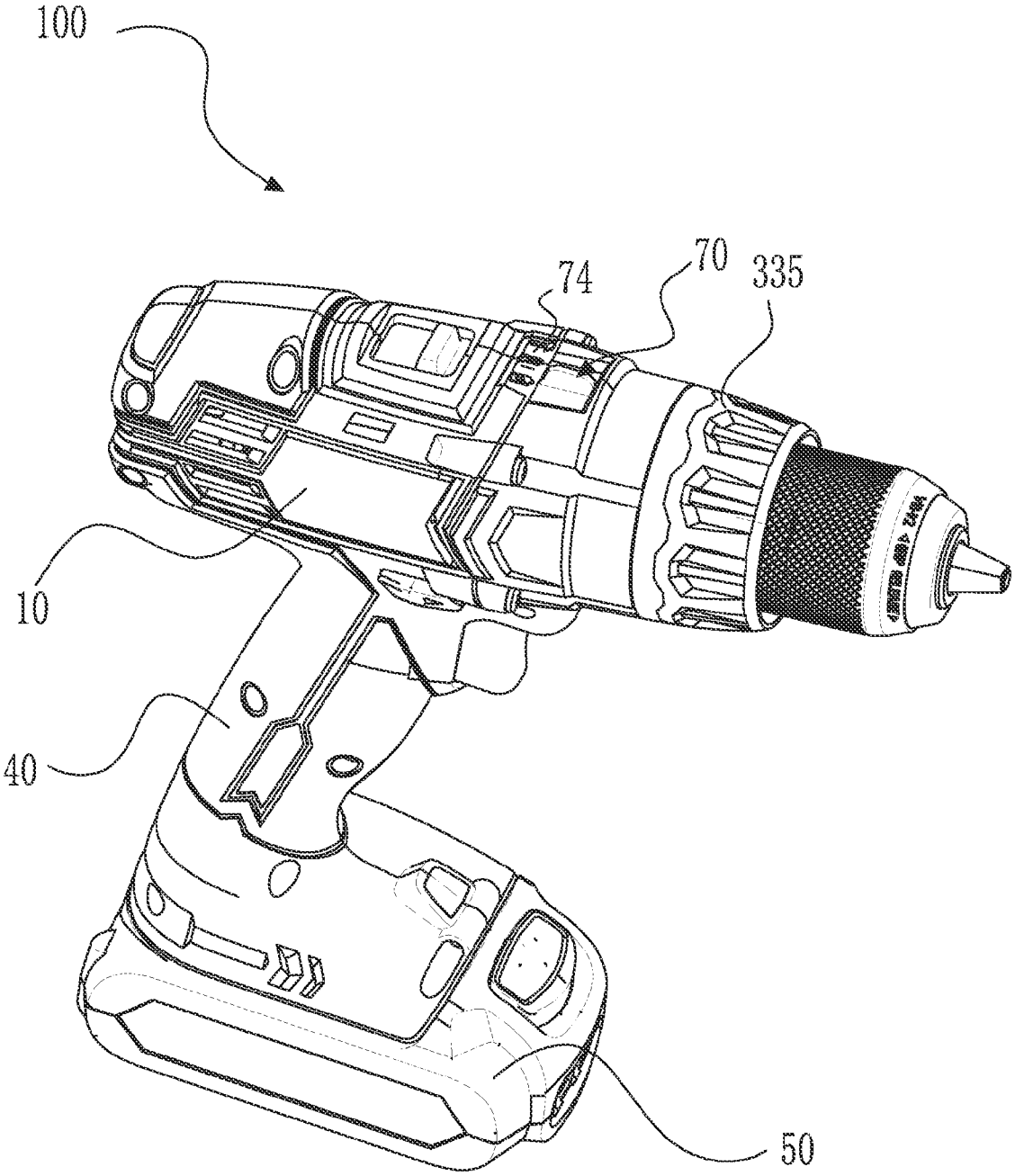
FIG. 1 is a schematic view of an exemplary multi-mode drill constructed according to the present disclosure.
Figure 2:
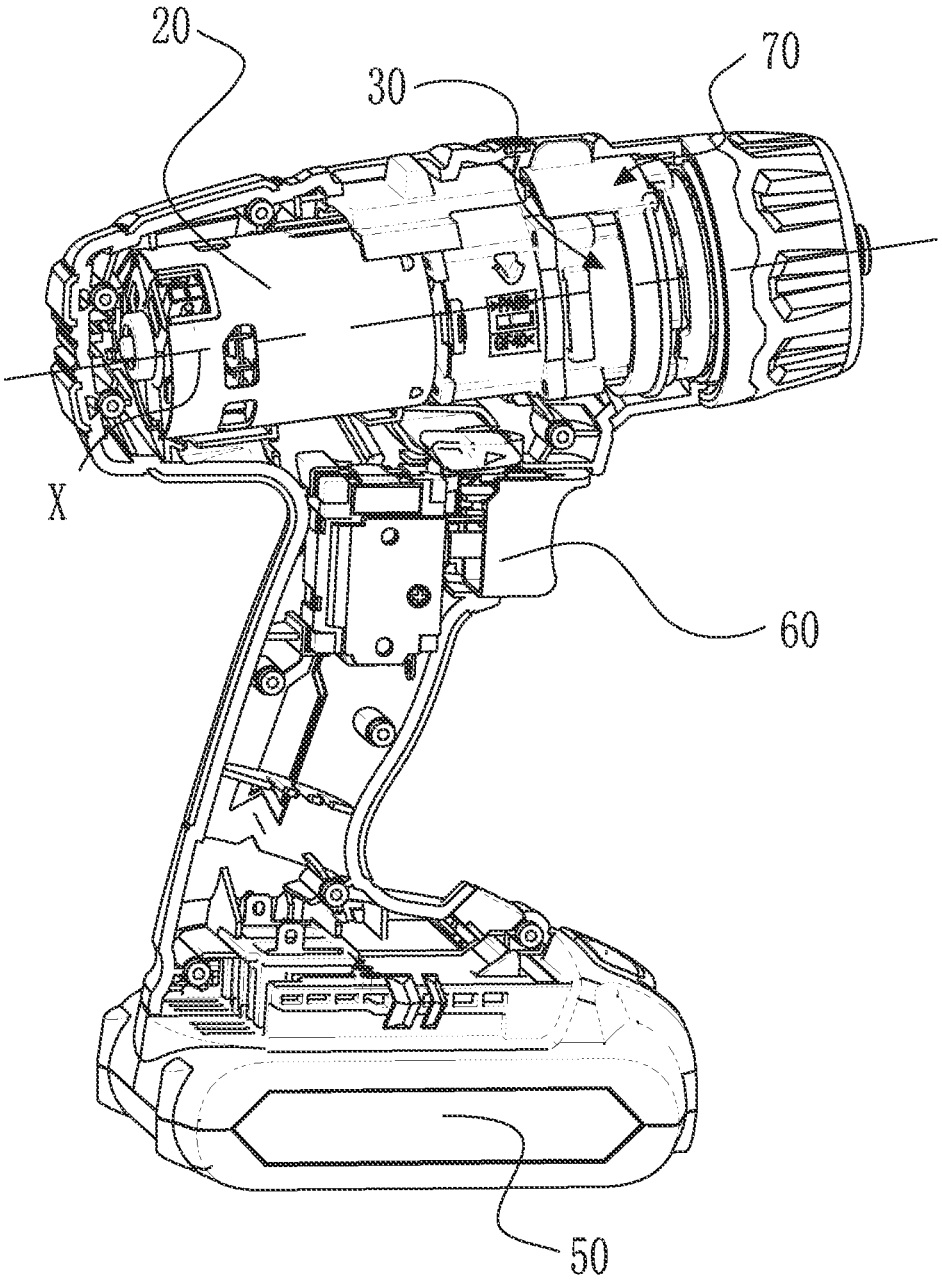
FIG. 2 is a schematic view showing internal structures of the device of FIG. 1.

Referring to FIGS. 1 and 2, the multi-mode drill 100 according to the present disclosure includes a housing 10, a motor 20 and a transmission mechanism 30. The motor 20 and the transmission mechanism 30 are received in the housing 10. The multi-mode drill 100 further includes a handle 40 substantially perpendicularly extending from the housing 10, a battery 50 provided under the handle 40, a main switch 60 electrically connected to the battery 50 and motor 20, and a mode switching mechanism 70.

Figure 3:
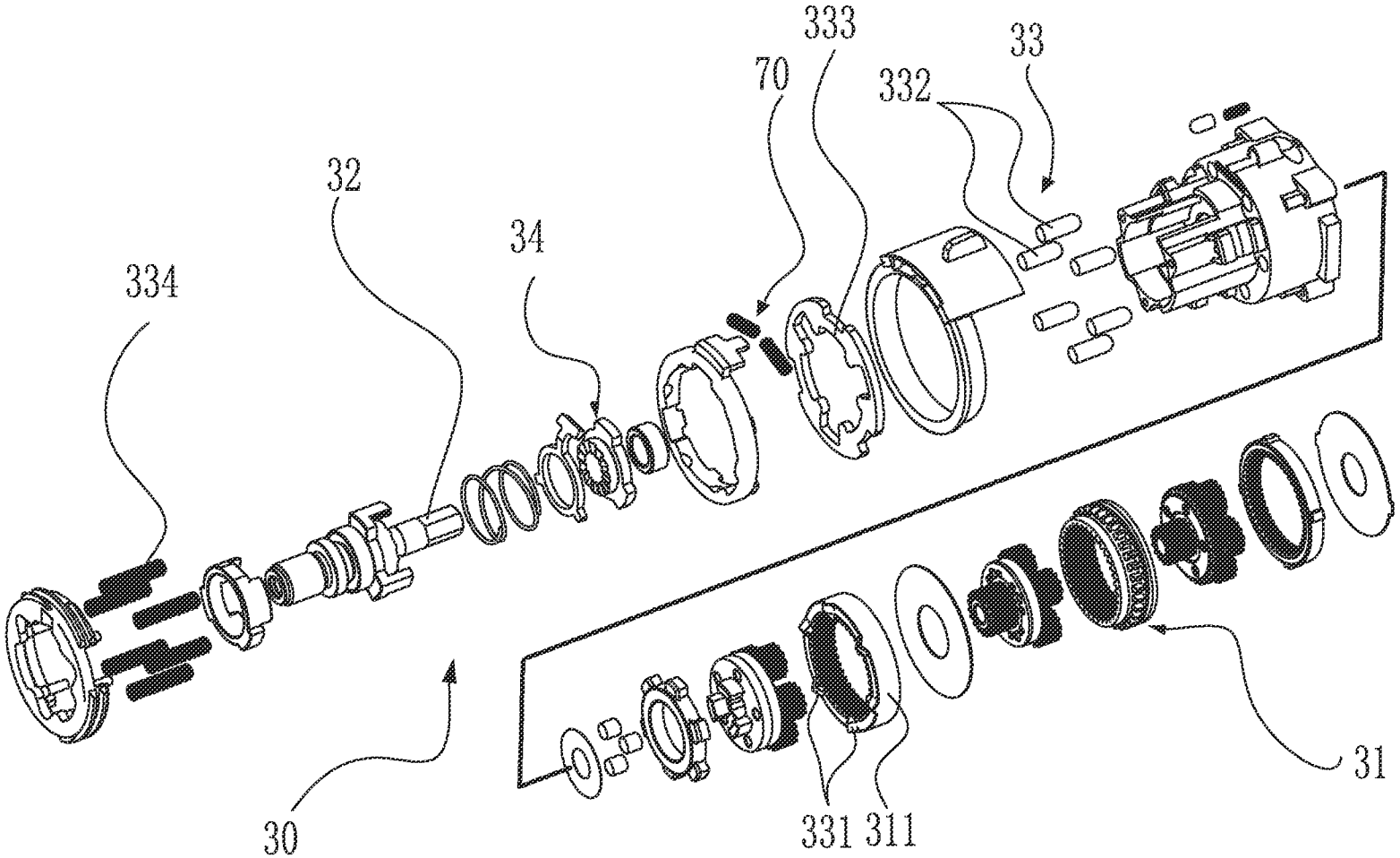
FIG. 3 is an exploded view of an exemplary transmission mechanism and mode switching mechanism in the device shown in FIG. 1.

Further referring to FIG. 3, the transmission mechanism 30 includes a planetary gear reduction component 31, a main shaft 32, a clutch component 33 and an impact component 34, wherein the planetary gear reduction component 31 is driven by the motor 20, and the main shaft 32 is connected with the planetary gear reduction component 31 and driven by the planetary gear reduction component 31 to rotate. It should be noted that, the planetary gear reduction component 31 may be constructed as a gear reduction component using another form. The transmission mechanism 30 of the multi-mode drill 100 has a drill mode, a clutch mode and a hammer drill mode. The mode switching mechanism 70 is capable of switching the transmission mechanism 30 to operate in the drill mode, the clutch mode or the hammer drill mode. The clutch component 33 is capable of interrupting the torque output of the main shaft 32 from the motor 20 when the torque greater than a predetermined threshold is imposed on the main shaft 32 in the clutch mode, and the clutch component 33 is inactive in the drill mode and hammer drill mode. The impact component 34 is for providing the transmission mechanism 30 with rotation and reciprocating impact of the output shaft in the hammer drill mode. The clutch component 33 and the impact component 34 are both inactive in the drill mode. It should be noted that, the transmission mechanism 30 may further have an impact mode and include a component for generating rotary impact. The impact component 34 may be omitted and the transmission mechanism 30 may only have the clutch mode and drill mode. In the present disclosure, the modes besides the clutch mode are referred to as non-clutch modes, and the clutch component and the process switching from the clutch mode to the non-clutch modes are mainly described.

The planetary gear reduction component 31 includes an internal gear 311, the clutch component 33 includes several protrusions 331 located at an end face of the internal gear 311, several engagement members 332 arranged to keep engagement with the end face of the internal gear 311, a pressing member 333 engaging with the engagement members 332, and a biasing member 334 biasing the pressing member 333. The clutch component 33 further includes a clutch cup 335 (see FIG. 1) for being operated for outside of the housing to adjust the predetermined torque threshold, that is to adjust the force of the engagement members 332 acting on the end face of the internal gear 311 through adjusting the biasing force of the biasing member 334, such as the known manner of screw thread or inclined plane. As a preferred solution, the engagement members 332 are formed as pin columns, the protrusions 331 are arranged at intervals with the pin columns, the pressing member 333 is formed as a washer, and the biasing member 334 is formed as several compression springs. Under normal conditions, engagement members 332 press the end face of the internal gear 311 as a result of the acting force of the biasing member 334, so the protrusions 331 located at the end face of the internal gear 311 cannot cross the engagement members 332, thereby internal gear 311 is fixed relative to the housing 10, and planetary gears meshing with the internal gear 311 drive the main shaft 32 to rotate. When the torque acting on the main shaft 32 exceeds the predetermined torque threshold, the force of planetary gears acting on the internal gear 311 is sufficient to overcome the force of the biasing member 334 acting on the end face of the internal gear 311, the protrusions 331 located at the end face of the internal gear 311 cross the engagement members 332, thereby the internal gear 311 rotates relative to the housing 10, the torque output of the main shaft 32 is cut off, that is skipping occurs. It should be noted that, the planetary gear reduction component 31 may be a 1-stage, 2-stage or multi-stage, the internal gear 311 for acting clutch function may be located at any stage of the planetary gear reduction component 31.

Figure 4:
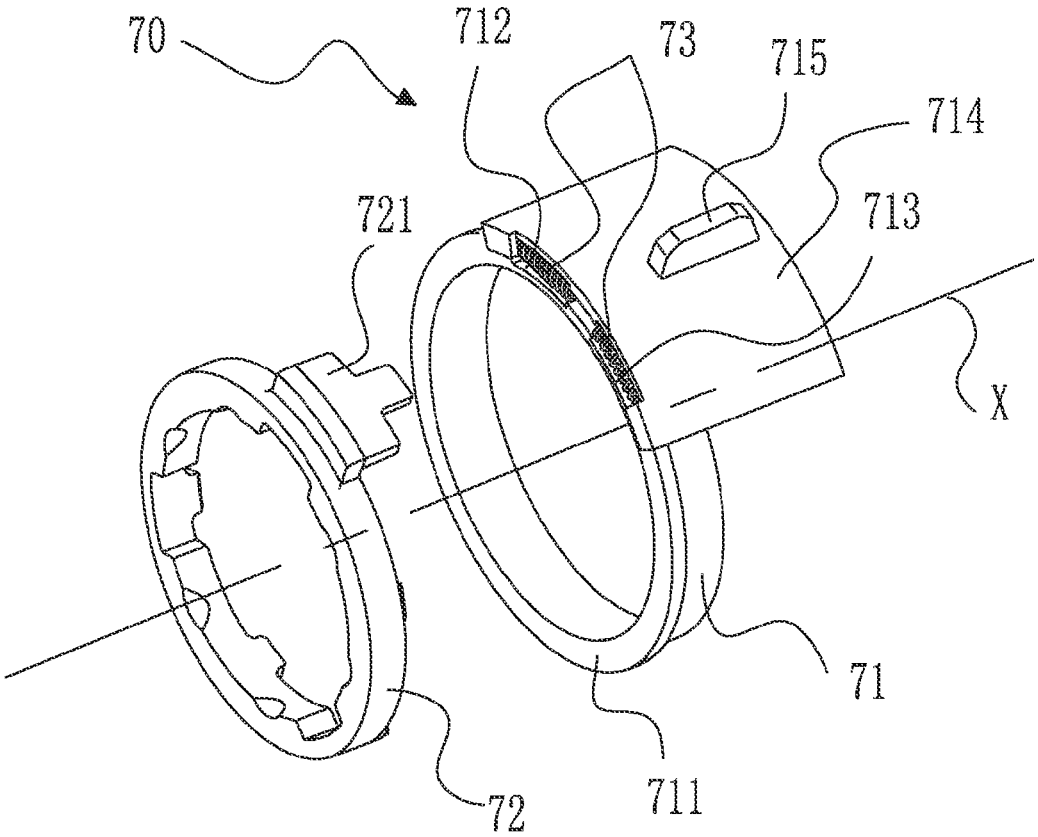
FIG. 4 is a schematic view of an exemplary mode switching mechanism in the device shown in FIG. 1.

Referring to FIG. 4, the mode switching mechanism 70 includes an operation member 71 and an actuator 72; the actuator 72 is actuated by the operation member 71 and engages with the transmission mechanism 30. The mode switching mechanism 70 further includes at least an elastic energy storage member 73 arranged between the operation member 71 and the actuator 72, so the operation member 71 can move relative to the actuator member 72. Therefore, when carrying out the mode switching, if the actuator 72 is locked by another member, the operation member 71 can still be moved in advance to the designated position, after the locked state relieves, the actuator 72 is moved to the corresponding position under the action of the elastic energy storage member 73. The operation member 71 is substantially ring-shaped and capable of rotating about a central axis X of the main shaft, the actuator 72 is substantially ring-shaped and arranged coaxially with the operation member 71, the elastic energy storage member 73 is a compression spring. It should be noted that, in other embodiments the operation member 71, the actuator 72 and elastic energy storage member 73 may also be configured using other forms. Circumferentially arranged different marks 74 (see FIG. 1) are provided on the housing 10 adjacent the operation member 71 to indicate the working modes of the transmission mechanism 30 corresponding to the different positions of the operation member 71. The operation member 71 includes a side wall 711 substantially perpendicular to the central axis X and defines a first chamber 712 and a second chamber 713 adjacent to the first chamber 712. Two elastic energy storage members 73 are respectively received in each of the first, second chambers 712,713, a stop boss 721 is arranged on the outer surface of the actuator 72 away from the central axis X, the stop boss 721 extends into the space between the two elastic energy storage members 73. As a preferred solution, the first and second chambers 712,713 are communicated with each other, the stop boss 721 can enter into the first and second chambers 712,713; the first and second chambers 712,713 are circumferentially arranged on the side wall 711 about the central axis X, the first, second chambers 712,713 and the stop boss 721 are generally arc-shaped. The elastic energy storage members 73 are substantially arc-shaped when received in the first, second chambers 712,713, thus when rotating the operation member 71, force can be evenly applied to the elastic energy storage members 73 and the actuator 72, then the operation is more stable. It should be noted that, in other embodiments, the first, second chambers 712,713 and the stop boss 721 may also be located at other positions of the operation member 71 and the actuator 72. The stop boss 721 can be biased by the corresponding elastic energy storage member 73 when the operation member 71 rotates clockwise or counterclockwise, preferably the stop boss 721 is in contact with both the two elastic energy storage members 73 under the free state of the two elastic energy storage members 73 with no energy stored. It also should be noted that, two or more stop bosses 721 may be arranged on the outer surface of the actuator 72 away from the central axis X, corresponding to it, the number of more first, second chambers 712,713 and elastic energy storage member 73 are provided at the same time, so the operation is more stable and has better feeling. The operation member 71 further has a flange 714 extending along the central axis X, an operation part 715 is provided on the flange 714, the operation part 715 extends outside the housing 10, other portions of the operation member 71 are received in the housing 10, the operator perform the mode switching through the operation unit 715. Only part of the operation member extends outside the housing, so the external space can be saved and the axial dimension of the tool is reduced.

The following is specific description of the blocking that may happen when switching from the clutch mode to the non-clutch mode, and the working process of the mode switching mechanism.

Figure 5:
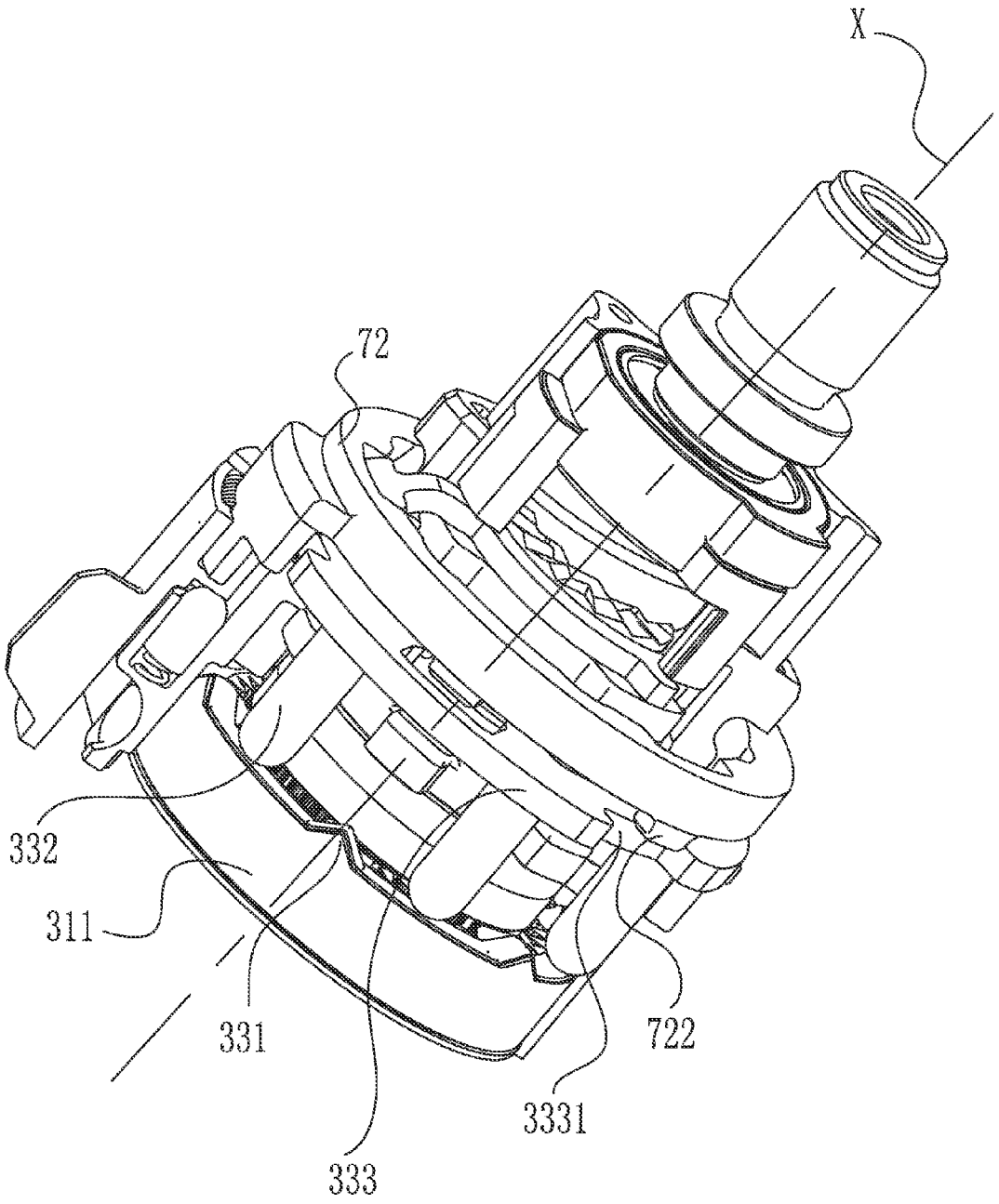
FIG. 5 is a schematic view of an exemplary transmission mechanism in the clutch mode according to the present disclosure.

Referring to FIG. 5, the actuator 72 has at least a protrusion 722 extending along an axis parallel with the central axis X, the pressing member 333 defines at least a notch 3331 corresponding to the protrusion 722. When the actuator 72 is not pressing on the pressing member 333, that is, the protrusion 722 of the actuator 72 is aiming aims at toward the notch 3331 of the pressing member 333, the pressing member 333 can slide along the central axis X under the action of the biasing member, the transmission mechanism 30 is in the clutch mode, and the predetermined torque threshold can be adjusted.

Figure 6A:
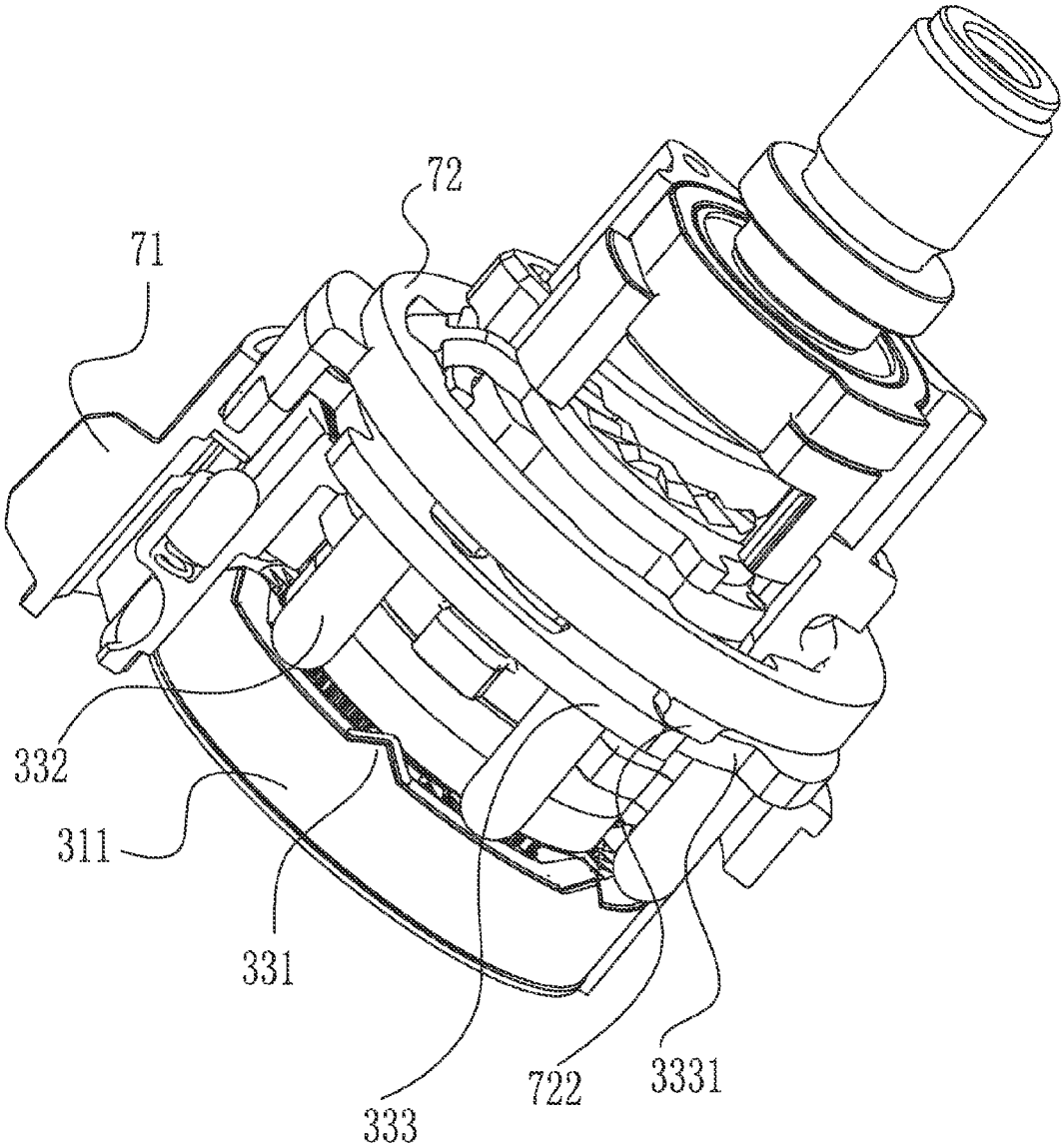
FIG. 6*a* is a schematic view of an exemplary transmission mechanism in the non-clutch mode according to the present disclosure.
Figure 6B:
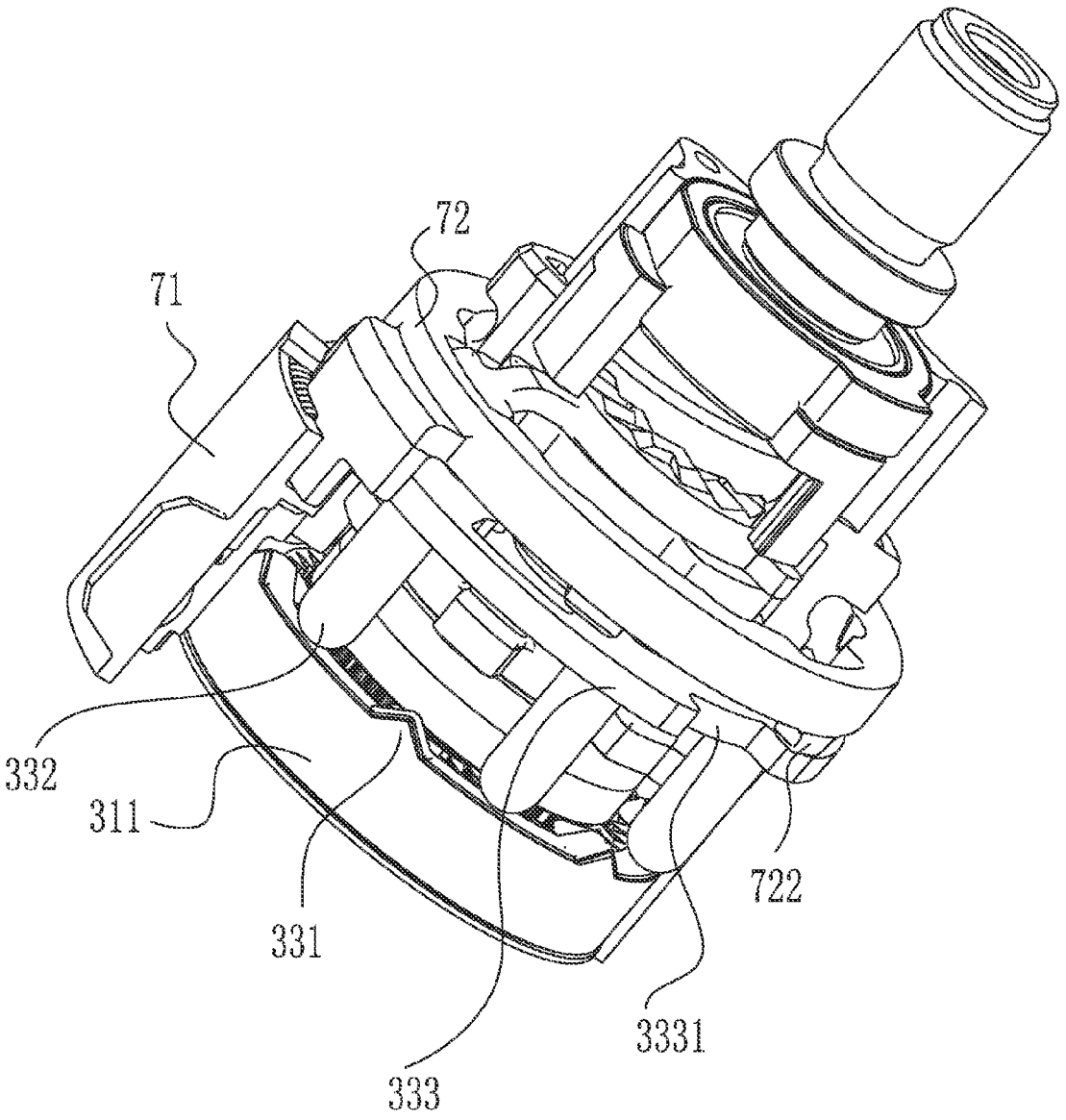
FIG. 6*b* is a schematic view of an exemplary transmission mechanism in another non-clutch mode according to the present disclosure.

Referring to FIGS. 6*a* and 6*b*, rotating the operation member 71 clockwise or counter-clockwise, the protrusion 722 of the actuator 72 deviates from the notch 3331 of the pressing member 333 and is pressing presses on the pressing member 333, thus the pressing member 333 and engagement members 332 are pressed on the end face of the internal gear 311 and cannot move, the pressing member 333 is no longer engaged by the biasing member, so the protrusions 331 at the end face of the internal gear 311 cannot cross the engagement members 332, the internal gear 311 cannot rotate relative to the housing 10, the transmission mechanism 30 is in a non-clutch mode.

Figure 7:
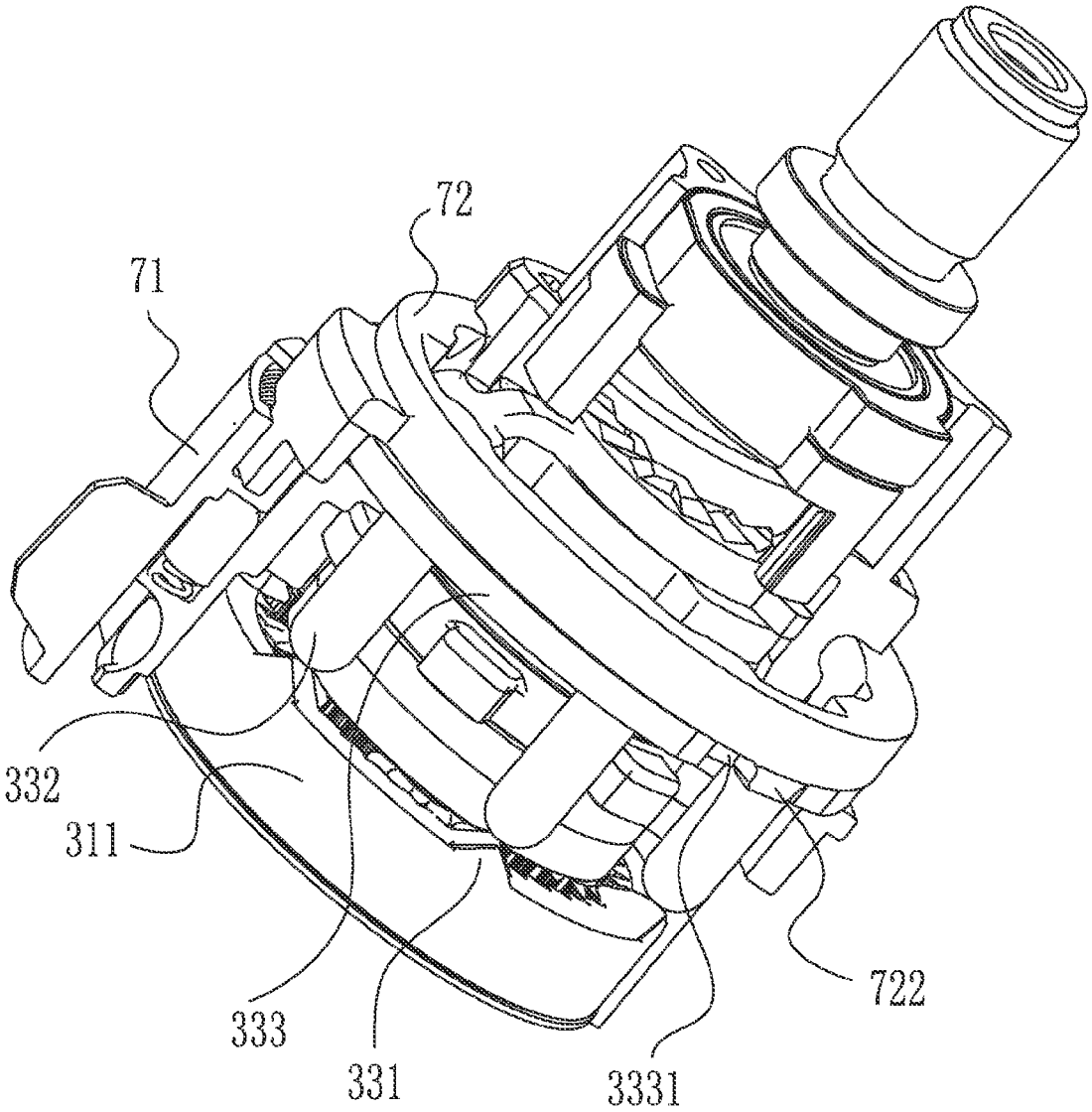
FIG. 7 is a schematic view of an exemplary transmission mechanism when skipping according to the present disclosure.

Once skipping happens in the clutch mode, the operator will release the main switch 60 to stop the motor 20 and then adjust the torque cup or switch the operation mode. Referring to FIG. 7, at this time if the engagement members 332 just falls on the protrusions 331 at the end face of the internal gear 311, the pressing member 333 moves along toward the actuator 72, so the protrusion 722 of the actuator 72 block into the notch 3331 of the pressing member 333, if the operation member 71 is directly connected with the actuator 72, the operation member 71 will not be rotated by the operator when switching the operation mode, that is, the situation of blocking occurs. According to the present disclosure, the elastic energy storage member 73 is arranged between the operation member 71 and the actuator 72, therefore, rotating the operation member 71, the elastic energy storage member 73 received in the first or second chamber is biased and engaging with the stop boss 721 according to the rotation direction, even if the actuator 72 is blocked, the operation member 71 can still be rotated to other mode positions and the corresponding elastic energy storage member 73 storages energy.

After the operation member 71 is rotated to the position corresponding to the non-clutch mode, the operator presses the main switch 60 to start the motor 20, the internal gear 311 is driven and the engagement members 332 fall back from the protrusions 331 at the end face of the internal gear 311, the actuator 72 is no longer prevented from moving by the pressing member 333, the elastic energy storage member 73 with energy stored releases the energy and engages with the stop boss 721 of the actuator 72, the actuator 72 is moved to the position corresponding to the non-clutch mode, that is, the protrusion 722 of the actuator 72 deviates from the position of the notch 3331 of the pressing member 333, the transmission mechanism 30 is switched to the non-clutch mode.

It also should be noted that, the mode switching mechanism 70 according to the present disclosure can also be used on other multi-mode tools.

According to the present disclosure, the elastic energy storage member 73 is arranged between the operation member 71 and the actuator 72, the blocking happened in the mode switching process due to the interaction of the internal mechanism is solved, especially the blocking of the operation member 71 resulting from skipping when switching from the clutch mode to the non-clutch mode. It provides good operation feelings; and the structure is simple and reliable, which is convenient for the operator to use.

The above shows and describes basic principles, main features and advantages of the present disclosure. Those skilled in the art should appreciate that the embodiments by no means limit the present disclosure. All technical solutions obtained by employing equivalent substitutes or equivalent variations fall within the protection scope of the present disclosure.

What is claimed is:

1. A multi-mode drill, comprising:

a housing;

a motor received in the housing;

a transmission mechanism received in the housing, the transmission mechanism comprising:

a gear reduction component driven by the motor; and a main shaft connected with the gear reduction component and driven by the gear reduction component to rotate; and a mode switching mechanism for switching the transmission mechanism to operate in different modes, the mode switching mechanism comprising:

an operation member;

an actuator actuated by the operation member and engaging with the transmission mechanism; and at least an elastic energy storage member arranged between the operation member and the actuator, wherein the transmission mechanism has a clutch mode and a non-clutch mode, the mode switching mechanism is provided for switching the transmission mechanism to operate in the clutch mode or the non-clutch mode, and the transmission mechanism further comprises a clutch component capable of interrupting the torque output of the main shaft from the motor when a torque greater than a predetermined threshold is imposed on the main shaft in the clutch mode, wherein the gear reduction component is a planetary gear reduction component which comprises an internal gear, the clutch component comprises several protrusions located at an end face of the internal gear, several engagement members are arranged to keep engagement with the end face of the internal gear, a pressing member engages with the engagement members, and at least a biasing member biases the pressing member, and wherein the actuator comprises at least a protrusion extending along an axis parallel with the central axis, the pressing member defines at least a notch corresponding to the protrusion, the protrusion aims towards the notch in the clutch mode, and the protrusion presses on the pressing member in the non-clutch mode.

2. The multi-mode drill according to claim 1, wherein the operation member is substantially ring-shaped and rotating about a central axis of the main shaft and the actuator is substantially ring-shaped and arranged coaxially with the operation member.

3. The multi-mode drill according to claim 2, wherein the operation member defines a first chamber and a second chamber adjacent to the first chamber, the multi-mode drill comprises two elastic energy storage members respectively received in each of the first and second chambers, the actuator comprises a stop boss extending into the space between the two elastic energy storage members, and the stop boss is biased by the corresponding elastic energy storage member when the operation member rotates clockwise or counterclockwise.

4. The multi-mode drill according to claim 3, wherein the first and second chambers are in communication with each other and the stop boss is arranged for entering into the first and second chambers.

5. The multi-mode drill according to claim 3, wherein the stop boss is in contact with both of the two elastic energy storage members under a free state of the two elastic energy storage members with no energy stored.

6. The multi-mode drill according to claim 3, wherein the operation member comprises a side wall substantially perpendicular to the central axis, the first and second chambers are circumferentially arranged on the side wall about the central axis, the first and second chambers and the stop boss are substantially arc-shaped, and the elastic energy storage members are substantially arc-shaped when received in the first and second chambers.

7. The multi-mode drill according to claim 1, further comprising circumferentially arranged different marks provided on the housing adjacent the operation member wherein the marks indicate the working modes of the transmission mechanism corresponding to the different positions of the operation member.

* * * * *